US010632752B2

(12) United States Patent
Chen et al.

(10) Patent No.: US 10,632,752 B2
(45) Date of Patent: Apr. 28, 2020

(54) PRINTED CIRCUIT BOARD FLUID FLOW STRUCTURE AND METHOD FOR MAKING A PRINTED CIRCUIT BOARD FLUID FLOW STRUCTURE

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Albany, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 14/769,903

(22) PCT Filed: Mar. 26, 2013

(86) PCT No.: PCT/US2013/033865
§ 371 (c)(1),
(2) Date: Aug. 24, 2015

(87) PCT Pub. No.: WO2014/133563
PCT Pub. Date: Sep. 4, 2014

(65) Prior Publication Data

US 2016/0023461 A1 Jan. 28, 2016

(30) Foreign Application Priority Data

Feb. 28, 2013 (WO) ..... PCT/US2013/028207

(51) Int. Cl.
*B41J 2/16* (2006.01)
*B41J 2/14* (2006.01)

(52) U.S. Cl.
CPC ..... *B41J 2/1623* (2013.01); *B41J 2/14016* (2013.01); *B41J 2/14201* (2013.01);
(Continued)

(58) Field of Classification Search
CPC ..... B41J 2/1623; B41J 2/1607; B41J 2/1601; B41J 2/14201; B41J 2/1632;
(Continued)

(56) References Cited

U.S. PATENT DOCUMENTS 4,633,274 A 12/1986 Matsuda
4,873,622 A 10/1989 Komuro et al.
(Continued)

FOREIGN PATENT DOCUMENTS

CN 1530229 9/2004
CN 1541839 A 11/2004
(Continued)

OTHER PUBLICATIONS

Kumar, Aditya et al.; Wafer Level Embedding Technology for 3D Wafer Level Embedded Package; Institute of Microelectronics, A*Star; 2Kinergy Ltd, TECHplace II; 2009 Electronic Components and Technology Conference.
(Continued)

*Primary Examiner* — Henok D Legesse
(74) *Attorney, Agent, or Firm* — Fabian VanCott

(57) ABSTRACT

In one example, a fluid flow structure includes a micro device embedded in a printed circuit board (PCB). Fluid may flow to the micro device through a channel in the PCB and a PCB conductor is connected to a conductor on the embedded micro device.

19 Claims, 10 Drawing Sheets

(52) U.S. Cl.
CPC ..... *B41J 2/1601* (2013.01); *B41J 2/1607* (2013.01); *B41J 2/1628* (2013.01); *B41J 2/1632* (2013.01); *B41J 2002/14491* (2013.01); *B41J 2202/19* (2013.01); *B41J 2202/20* (2013.01)

(58) Field of Classification Search
CPC .. B41J 2/14016; B41J 2/1628; B41J 2202/20; B41J 2202/19; B41J 2002/14491; B41J 2/1637; B41J 2/162; B41J 2002/14419
USPC ..... 347/49, 50
See application file for complete search history.

(56) References Cited

U.S. PATENT DOCUMENTS

| | | | | |
|---|---|---|---|---|
| 6,145,965 | A | 11/2000 | Inada et al. | |
| 6,188,414 | B1 * | 2/2001 | Wong | B41J 2/14024 347/42 |
| 6,250,738 | B1 | 6/2001 | Waller et al. | |
| 6,402,301 | B1 | 6/2002 | Powers et al. | |
| 6,554,399 | B2 | 4/2003 | Wong et al. | |
| 7,490,924 | B2 | 2/2009 | Haluzak et al. | |
| 7,591,535 | B2 | 9/2009 | Nystrom et al. | |
| 7,614,733 | B2 | 11/2009 | Haines | |
| 7,658,470 | B1 | 2/2010 | Jones et al. | |
| 7,824,013 | B2 | 11/2010 | Chung-Long et al. | |
| 7,877,875 | B2 | 2/2011 | O'Farrell et al. | |
| 8,177,330 | B2 * | 5/2012 | Suganuma | B41J 2/1408 347/50 |
| 8,235,500 | B2 | 8/2012 | Nystrom et al. | |
| 8,246,141 | B2 | 8/2012 | Petruchik et al. | |
| 8,272,130 | B2 | 9/2012 | Miyazaki | |
| 8,342,652 | B2 | 1/2013 | Nystrom et al. | |
| 2001/0071490 | | 3/2001 | Takashi et al. | |
| 2002/0180825 | A1 | 12/2002 | Buswell et al. | |
| 2004/0032468 | A1 | 2/2004 | Killmeier et al. | |
| 2005/0018016 | A1 * | 1/2005 | Silverbrook | B41J 2/14314 347/54 |
| 2005/0024444 | A1 | 2/2005 | Conta et al. | |
| 2005/0030358 | A1 | 2/2005 | Haines | |
| 2005/0122378 | A1 | 6/2005 | Touge | |
| 2007/0153070 | A1 | 7/2007 | Haines et al. | |
| 2008/0079781 | A1 | 4/2008 | Shim et al. | |
| 2008/0259125 | A1 * | 10/2008 | Haluzak | B41J 2/16 347/50 |
| 2009/0009559 | A1 * | 1/2009 | Jindai | B41J 2/14024 347/50 |
| 2009/0051717 | A1 | 2/2009 | Kuwahara | |
| 2009/0225131 | A1 | 9/2009 | Chen et al. | |
| 2010/0271445 | A1 | 10/2010 | Sharan et al. | |
| 2011/0019210 | A1 | 1/2011 | Chung et al. | |
| 2011/0037808 | A1 * | 2/2011 | Ciminelli | B41J 2/14072 347/50 |
| 2011/0080450 | A1 | 4/2011 | Ciminelli et al. | |
| 2011/0141691 | A1 | 6/2011 | Slaton et al. | |
| 2011/0222239 | A1 | 9/2011 | Dede | |
| 2011/0292124 | A1 | 12/2011 | Anderson et al. | |
| 2011/0292126 | A1 | 12/2011 | Nystrom et al. | |
| 2011/0298868 | A1 * | 12/2011 | Fielder | B41J 2/155 347/45 |
| 2012/0019593 | A1 | 1/2012 | Scheffelin et al. | |
| 2012/0124835 | A1 | 5/2012 | Okano et al. | |
| 2012/0210580 | A1 | 8/2012 | Dietl | |
| 2012/0212540 | A1 * | 8/2012 | Dietl | B41J 2/14024 347/29 |

FOREIGN PATENT DOCUMENTS

| | | | |
|---|---|---|---|
| CN | 1872554 | | 12/2006 |
| CN | 102470672 | A | 5/2012 |
| CN | 102673155 | | 9/2012 |
| EP | 1095773 | | 5/2001 |
| JP | 2000108360 | | 4/2001 |
| JP | 2006321222 | | 11/2006 |
| JP | 2010137460 | | 6/2010 |
| WO | WO-2008134202 | A1 | 11/2008 |
| WO | WO-20 8151216 | A1 | 12/2008 |
| WO | WO-2011019529 | A1 | 2/2011 |
| WO | WO-2012011972 | | 1/2012 |
| WO | WO-2012134480 | | 10/2012 |

OTHER PUBLICATIONS

Lee, J-D. et al.; A Thermal Inkjet Printhead with a Monolithically Fabricated Nozzle Plate and Self-aligned Ink Feed Hole; http://ieeexplore.ieee.org/stamp/stamp.jsp?tp=&ar number=788625; pp. 229-236; vol. 8; Issue 3; Sep. 1999.

Lindemann, T. et al.; One Inch Thermal Bubble Jet Printhead with Laser Structured Integrated Polyimide Nozzle Plate; http://ieeexplore.ieee.org/stamp/stamp.jsp?tp=&arnumber =4147592; pp. 420-428; vol. 16; Issue 2; Apr. 2007.

* cited by examiner

PRINTED CIRCUIT BOARD FLUID FLOW STRUCTURE AND METHOD FOR MAKING A PRINTED CIRCUIT BOARD FLUID FLOW STRUCTURE

BACKGROUND

Each printhead die in an inkjet pen or print bar includes tiny channels that carry ink to the ejection chambers. Ink is distributed from the ink supply to the die channels through passages in a structure that supports the printhead die(s) on the pen or print bar. It may be desirable to shrink the size of each printhead die, for example to reduce the cost of the die and, accordingly, to reduce the cost of the pen or print bar. The use of smaller dies, however, can require changes to the larger structures that support the dies, including the passages that distribute ink to the dies.

DRAWINGS

The same part numbers designate the same or similar parts throughout the figures. The figures are not necessarily to scale. The relative size of some parts is exaggerated to more clearly illustrate the example shown.

DESCRIPTION

Figure 1:
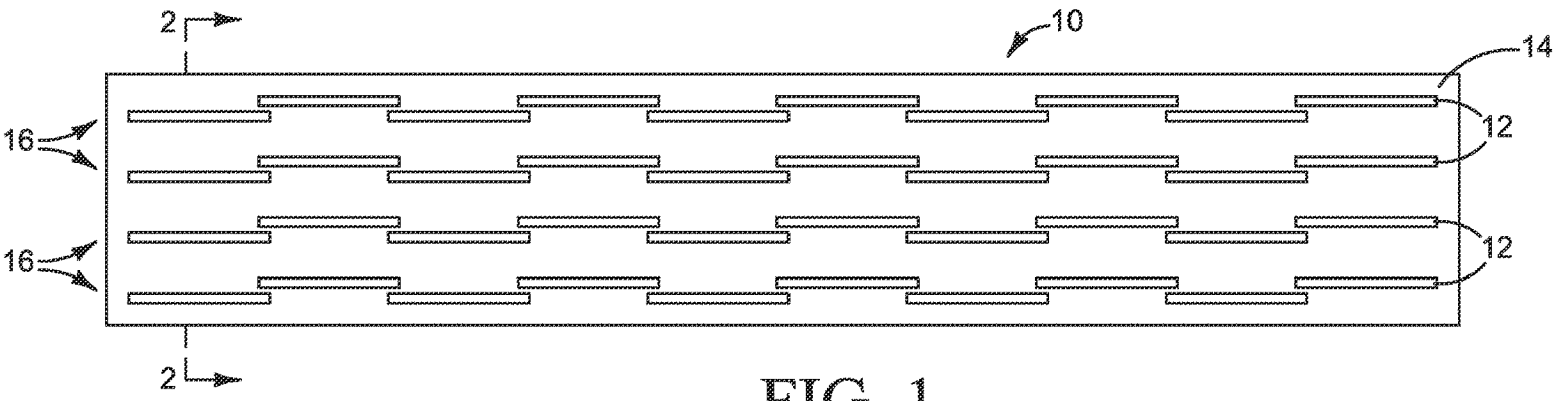
FIGS. 1-5 illustrate an inkjet print bar implementing one example of a new printhead flow structure.

Inkjet printers that utilize a substrate wide print bar assembly have been developed to help increase printing speeds and reduce printing costs. Conventional substrate wide print bar assemblies include multiple parts that carry printing fluid from the printing fluid supplies to the small printhead dies from which the printing fluid is ejected on to the paper or other print substrate. While reducing the size and spacing of the printhead dies continues to be important for reducing cost, channeling printing fluid from the larger supply components to ever smaller, more tightly spaced dies requires complex flow structures and fabrication processes that can actually increase cost.

A new fluid flow structure has been developed to enable the use of smaller printhead dies and more compact die circuitry to help reduce cost in substrate wide inkjet printers. A printhead structure implementing one example of the new flow structure includes multiple printhead dies glued or otherwise mounted in openings in a printed circuit board. Each opening forms a channel through which printing fluid may flow directly to a respective die. Conductive pathways in the printed circuit board connect to electrical terminals on the dies. The printed circuit board in effect grows the size of each die for making fluid and electrical connections and for attaching the dies to other structures, thus enabling the use of smaller dies. The ease with which printed circuit boards can be fabricated and processed also helps simply the fabrication of page wide print bars and other printhead structures as new, composite structures with built-in printing fluid channels, eliminating the difficulties of forming the printing fluid channels in a silicon substrate.

The new fluid flow structure is not limited to print bars or other types of printhead structures for inkjet printing, but may be implemented in other devices and for other fluid flow applications. Thus, in one example, the new structure includes a micro device embedded in a printed circuit board having a channel therein through which fluid may flow to the micro device. The micro device, for example, could be an electronic device, a mechanical device, or a microelectromechanical system (MEMS) device. The fluid flow, for example, could be a cooling fluid flow into or onto the micro device or fluid flow into a printhead die or other fluid dispensing micro device.

These and other examples shown in the figures and described below illustrate but do not limit the invention, which is defined in the Claims following this Description.

As used in this document, a "printed circuit board" means a non-conductive substrate with conductive pathways for mechanically supporting and electrically connecting to an electronic device (printed circuit board is sometimes abbreviated "PCB"); a "micro device" means a device having one or more exterior dimensions less than or equal to 30 mm; "thin" means a thickness less than or equal to 650 μm; a "sliver" means a thin micro device having a ratio of length to width (L/W) of at least three; a "printhead" and a "printhead die" mean that part of an inkjet printer or other inkjet type dispenser that dispenses fluid from one or more openings. A printhead includes one or more printhead dies. "Printhead" and "printhead die" are not limited to printing with ink and other printing fluids but also include inkjet type dispensing of other fluids and/or for uses other than printing.

Figure 2:
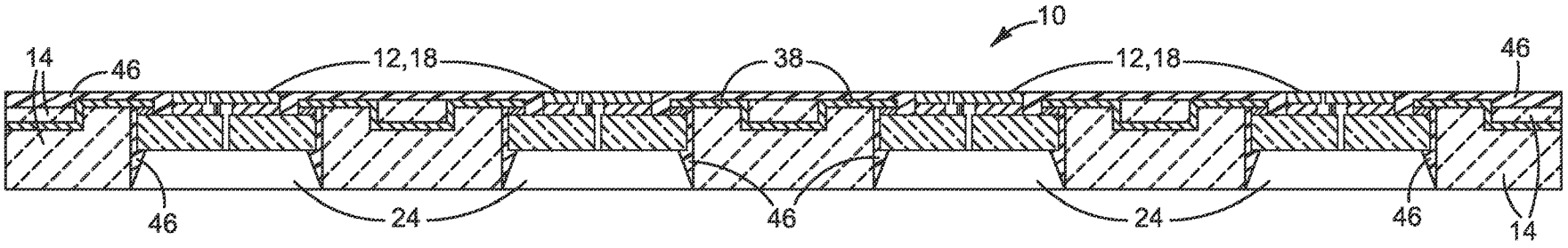
Figure 3:
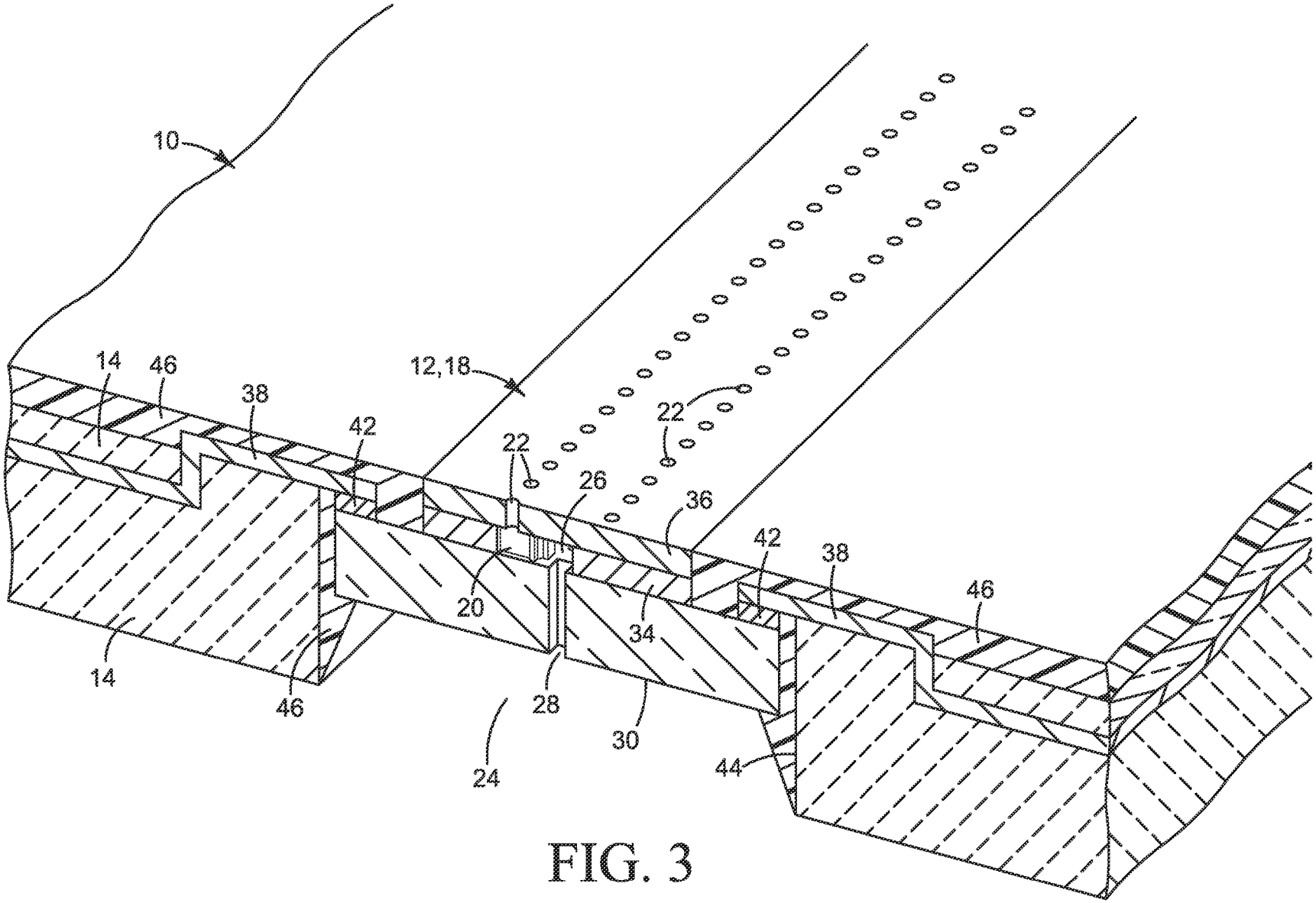
Figure 4:
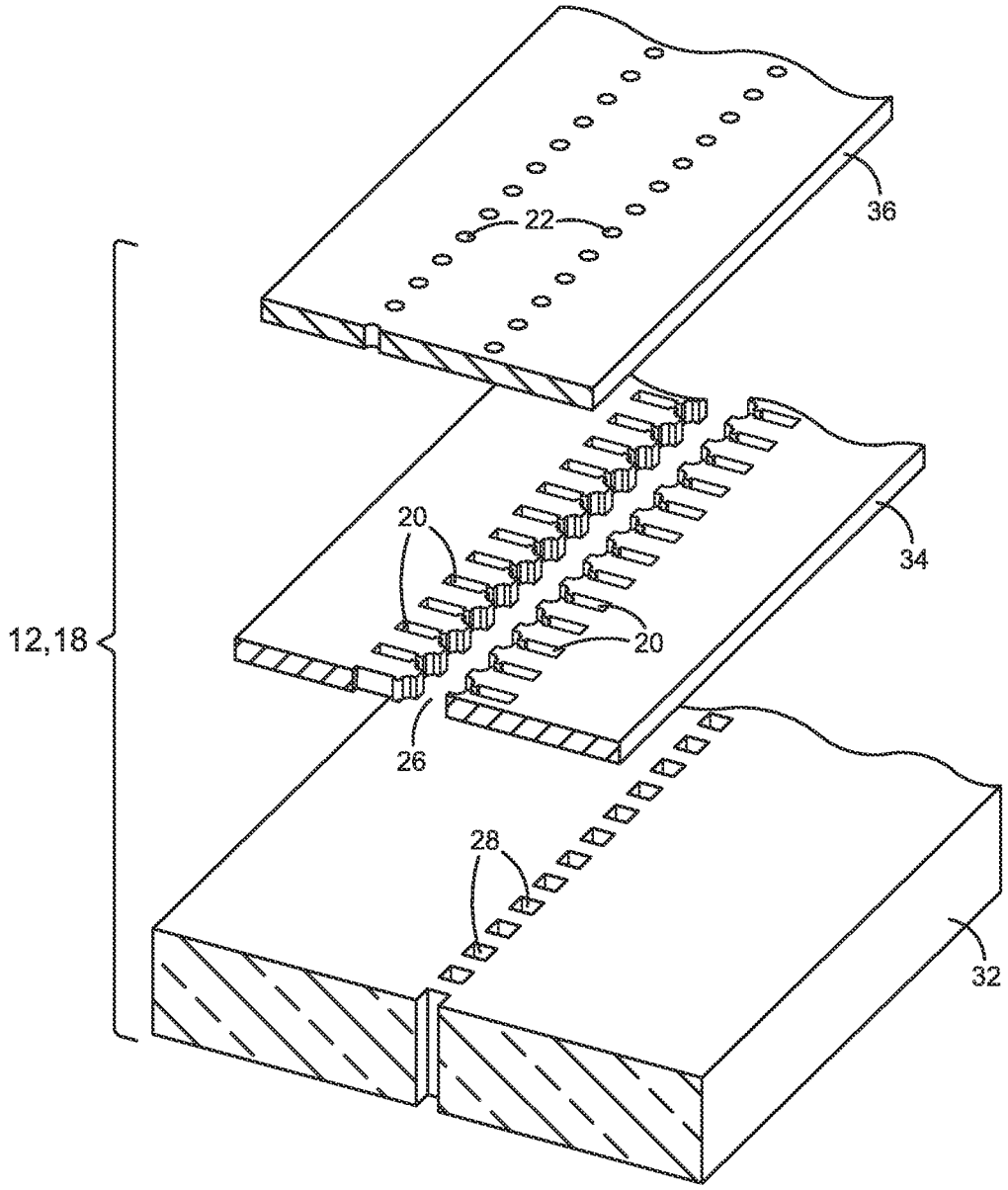
Figure 5:
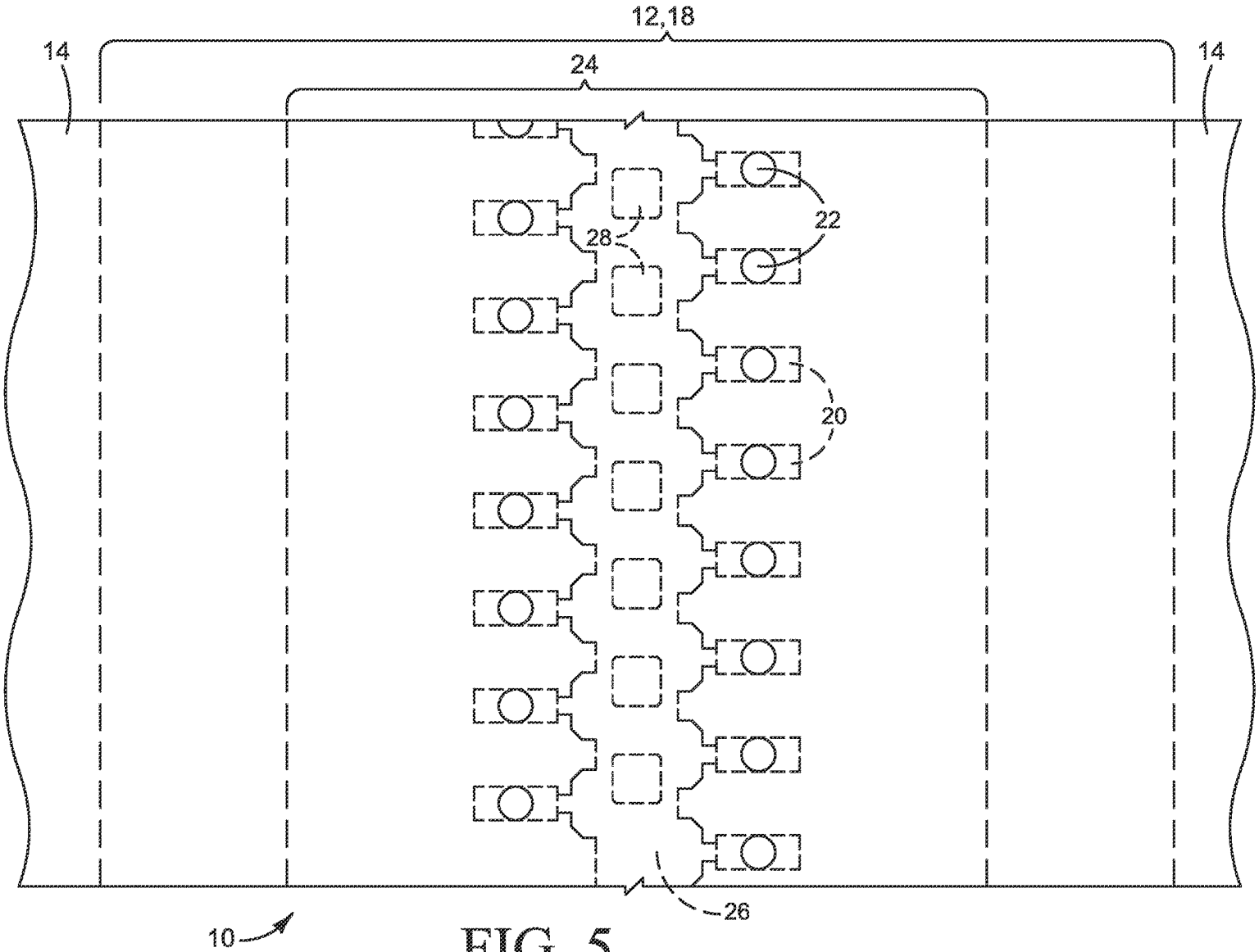

FIGS. 1-5 illustrate one example of a new inkjet printhead structure 10 in which printhead dies are embedded in a printed circuit board with fluid flow channels. In this example, printhead structure 10 is configured as an elongated print bar such as might be used in a single pass substrate wide printer. Referring first to FIGS. 1 and 2, printheads 12 are embedded in an elongated printed circuit board 14 and arranged generally end to end in rows 16 in a staggered configuration in which the printheads 12 in each row overlap another printhead 12 in that row. Although four rows 16 of staggered printheads 12 are shown, for printing four different colors for example, other suitable configurations are possible. FIGS. 3-5 are detail views of one of the die slivers 12 shown in FIG. 2. Referring now to FIGS. 1-5, in the example shown, each printhead 12 includes a single printhead die sliver 18 with two rows of ejection chambers 20 and corresponding orifices 22 through which printing fluid is ejected from chambers 20. A channel 24 in printed circuit board 14 supplies printing fluid to each printhead die sliver 18. Other suitable configurations for each printhead 12 are possible. For example, more or fewer printhead die slivers 18 may be used with more or fewer ejection chambers 20 and channels 24 or larger dies 18 (not slivers) may be used.

Printing fluid flows into each ejection chamber 20 from a manifold 26 extending lengthwise along each die sliver 18 between the two rows of ejection chambers 20. Printing fluid feeds into manifold 26 through multiple ports 28 that are connected to a printing fluid supply channel 24 at die surface 30. The idealized representation of a printhead die 18 in FIGS. 1-5 depicts three layers 32, 34, 36 for convenience only to clearly show ejection chambers 20, orifices 22, manifold 26, and ports 28. An actual inkjet printhead die sliver 18 is a typically complex integrated circuit (IC) structure formed on a silicon substrate 32 with layers and elements not shown in FIGS. 1-5. For example, a thermal ejector element or a piezoelectric ejector element formed (not shown) on substrate 32 at each ejection chamber 20 is actuated to eject drops or streams of ink or other printing fluid from orifices 22. Conductors 38 covered by a protective layer 40 and attached to electrical terminals 42 on substrate 32 carry electrical signals to ejector and/or other elements of printhead die sliver 18.

Figure 9:
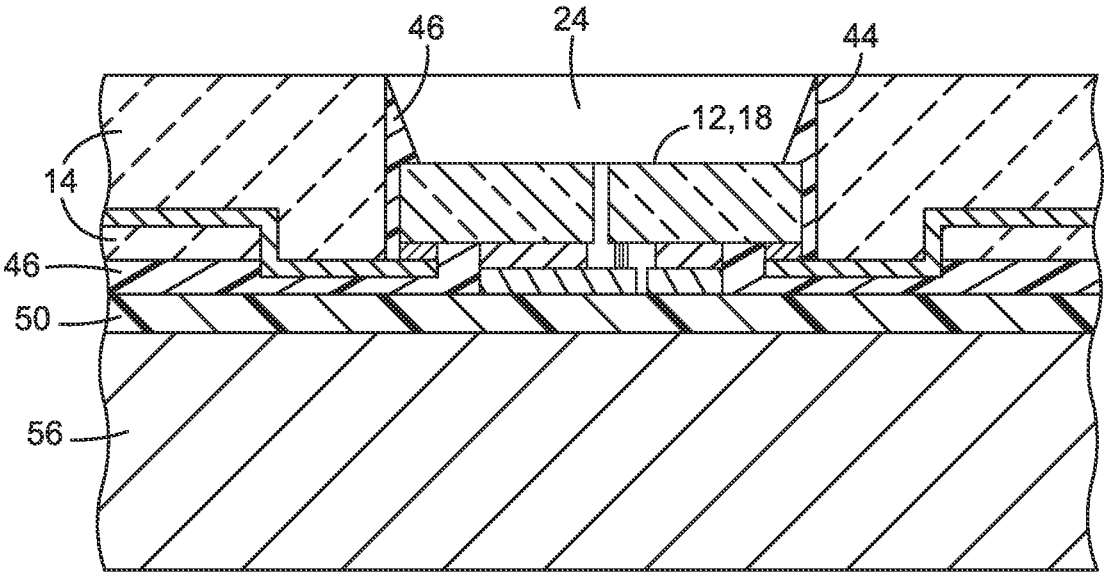
Figure 10:
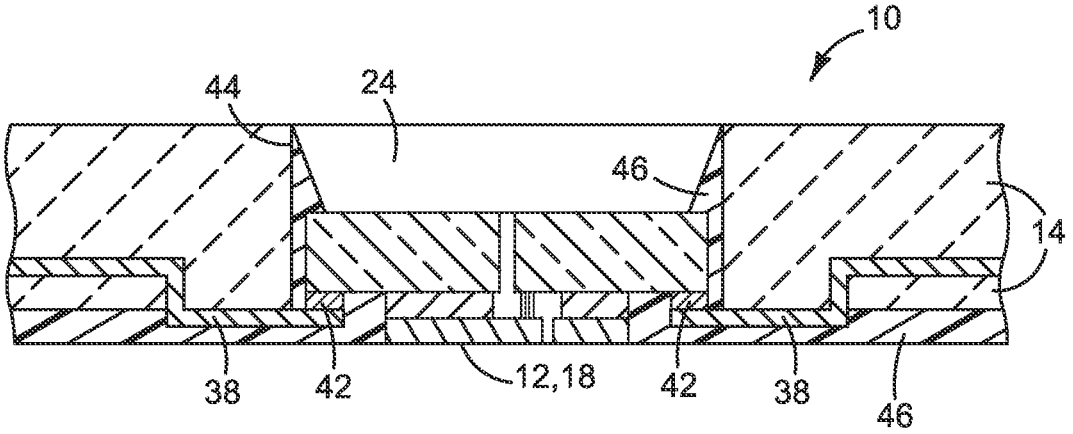
Figure 11:
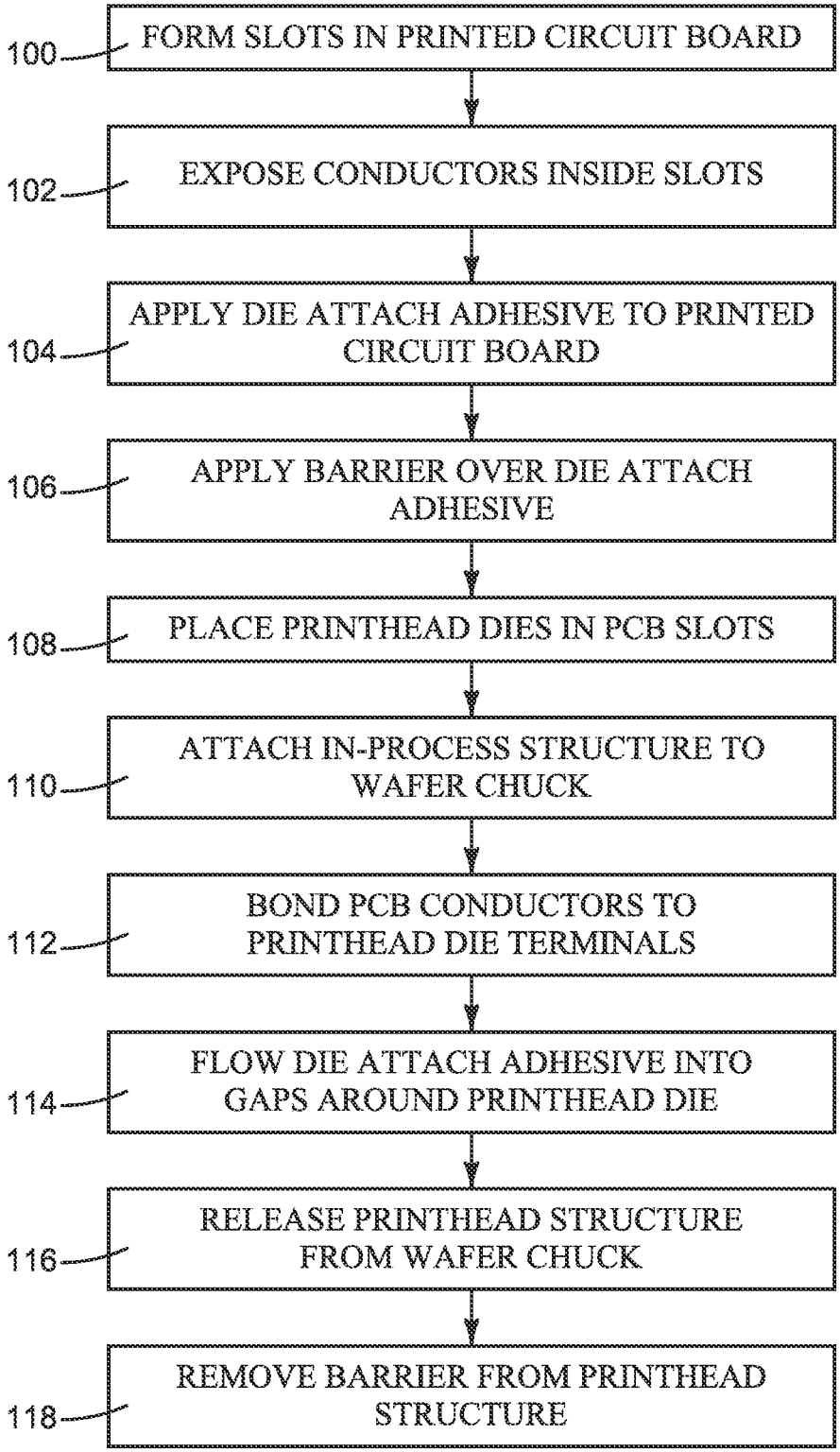

FIGS. 6-10 illustrate one example process for making a printhead structure 10 such as the one shown in FIGS. 1-5. FIG. 11 is a flow diagram of the process illustrated in FIGS. 6-10. Although a process for making a printhead structure 10 with printhead dies 18 is shown, the process may be used to form other fluid flow structures using other micro devices. Also, while only one printhead structure 10 is shown, the process may be used to simultaneously fabricate multiple printhead structures 10. Indeed, one of the advantages of embedding dies 18 in a printed circuit board 14 with channels 24 is the ease with which a print circuit board 14 may be made to different sizes to accommodate individual, group or wafer level fabrication.

Figure 6:
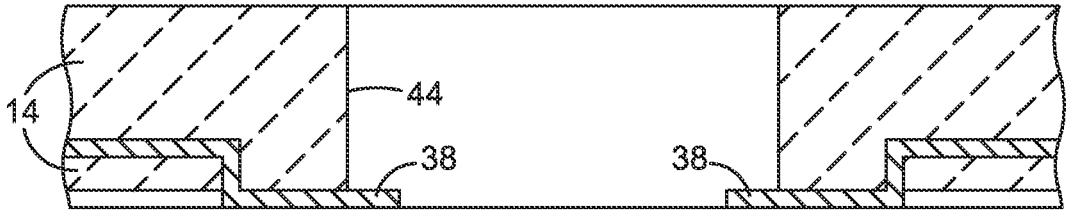
FIGS. 6-11 illustrate one example of a process for making a printhead flow structure such as might be used in the print bar shown in FIGS. 1-5.
Figure 7:
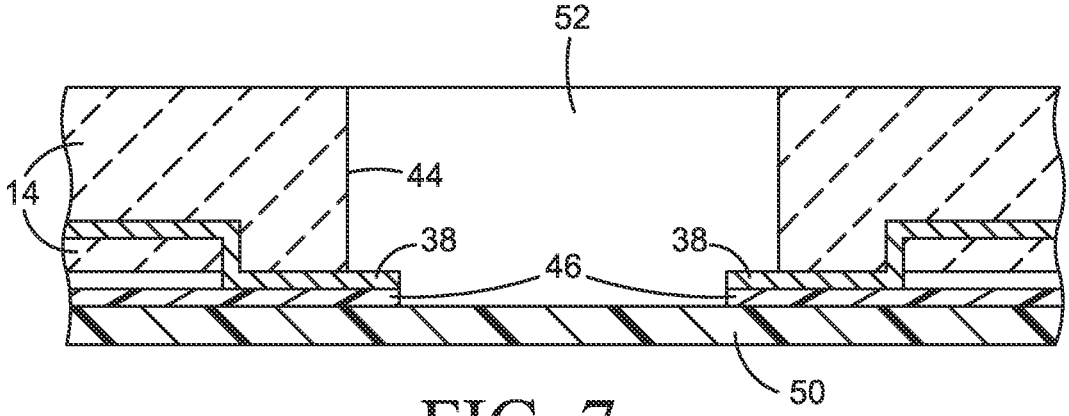
Figure 8:
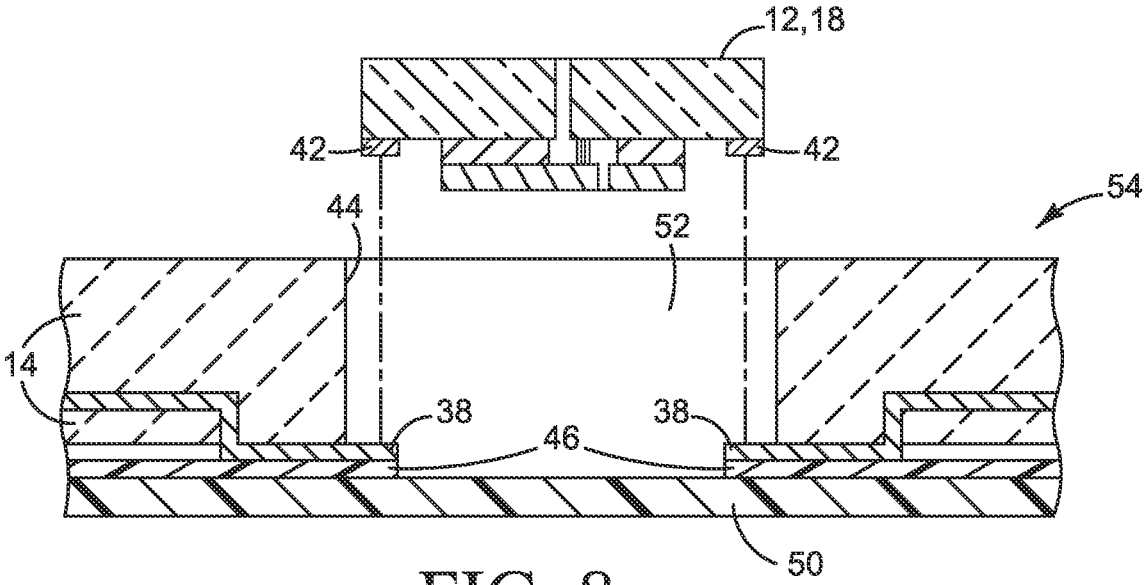

Referring first to FIG. 6, in preparation for receiving a printhead die, a slot 44 is sawn or otherwise formed in printed circuit board 14 and conductors 38 exposed inside slot 44 (steps 100 and 102 in FIG. 11). In FIG. 7, a patterned die attach film or other suitable adhesive 46 is applied to printed circuit board 14 and a PET (polyethylene terephthalate) film or other suitable barrier 50 applied over die attach film 46 (steps 104 and 106 in FIG. 11). Barrier 50 spanning slot 48 forms a cavity 52 for receiving printhead die 18 (step 108 in FIG. 11) and provides a mounting surface for attaching the in-process structure 54 shown in FIG. 8 to a wafer chuck 56 as shown in FIG. 9 (step 110 in FIG. 11).

In FIG. 9, PCB conductors 38 are bonded to printhead die terminals 42 (step 112 in FIG. 11) and die attach adhesive 46 is flowed into the gaps around printhead die 18 (step 114 in FIG. 11). Die attach adhesive 46 forms the glue that holds printhead die 18 in slot 44. Die attach adhesive 46 also seals the embedded die 18 in channel 24. Accordingly, although any suitable adhesive may be used for die attach 46, including die attach films commercially available for semiconductor fabrication, the adhesive should resist the corrosive effect (if any) of the ink or other printing fluids in channel 24.

In one example for bonding and flowing, solder or conductive adhesive is applied to one or both conductors 38 and terminals 42 before assembly (FIG. 8) and the structure heated after assembly (FIG. 9) to reflow the solder to bond conductors 38 and terminals 42 and to flow (or wick) adhesive 46 into the gaps around printhead die 18 as shown in FIG. 9. Printhead structure 10 is then released from chuck 56 and barrier 50 removed as shown in FIG. 10 (steps 116 and 118 in FIG. 11).

Figure 12:
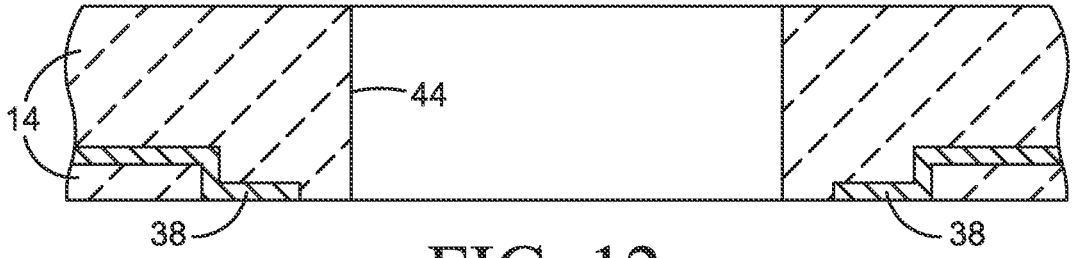
FIGS. 12-18 illustrate another example of a process for making a printhead flow structure such as might be used in a print bar like the one shown in FIGS. 1-5.
Figure 13:
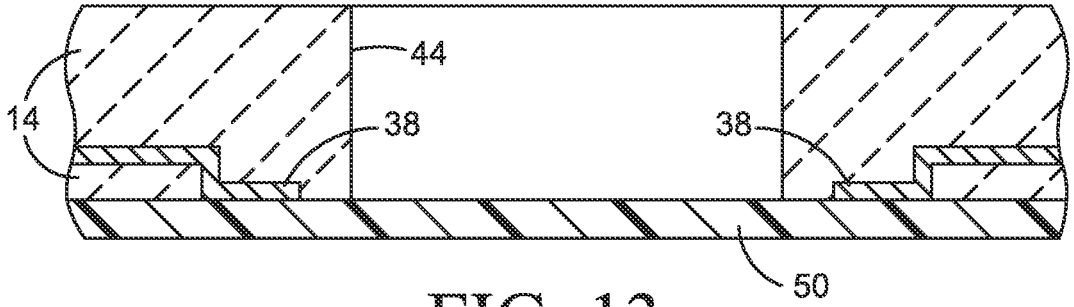
Figure 14:
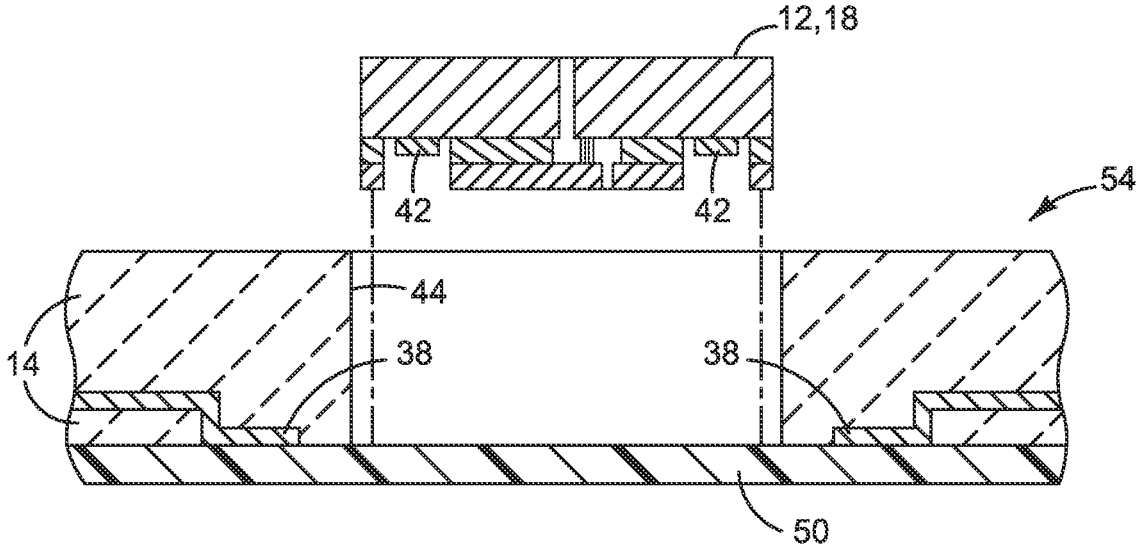
Figure 15:
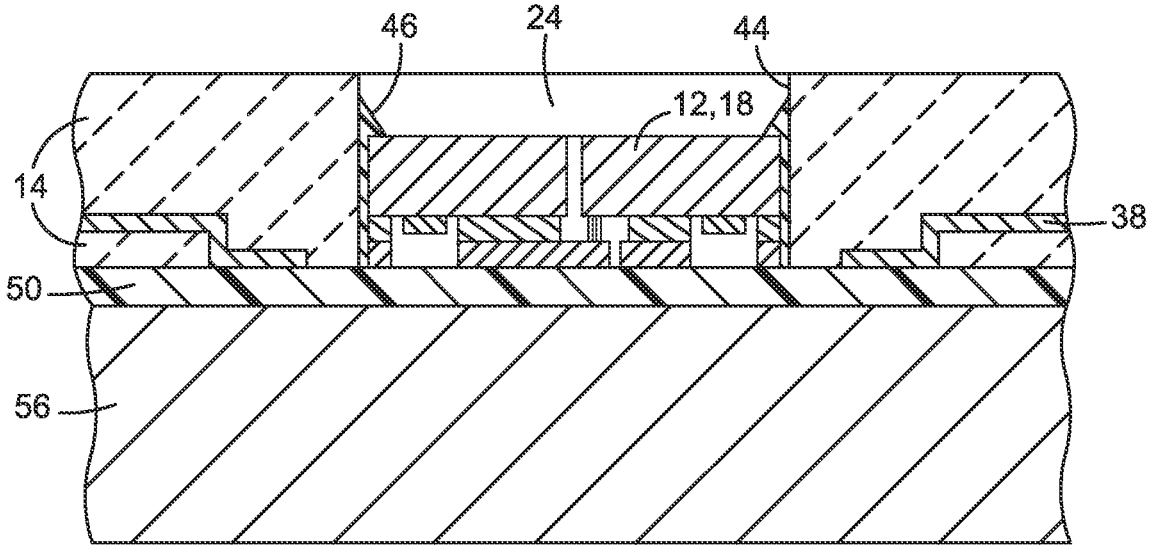
Figure 16:
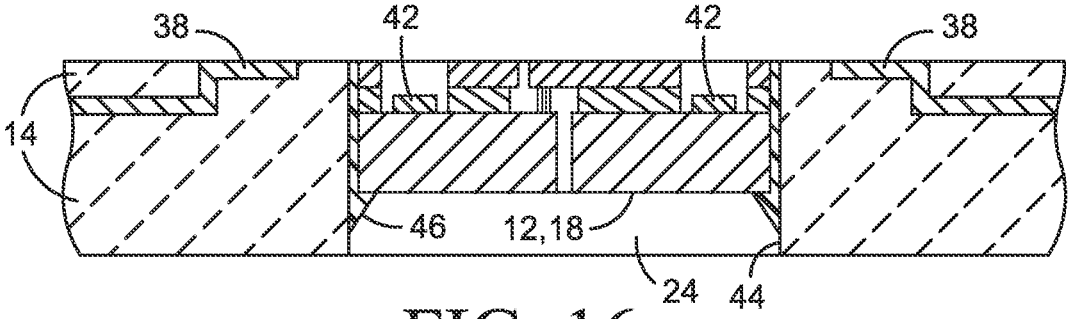
Figure 17:
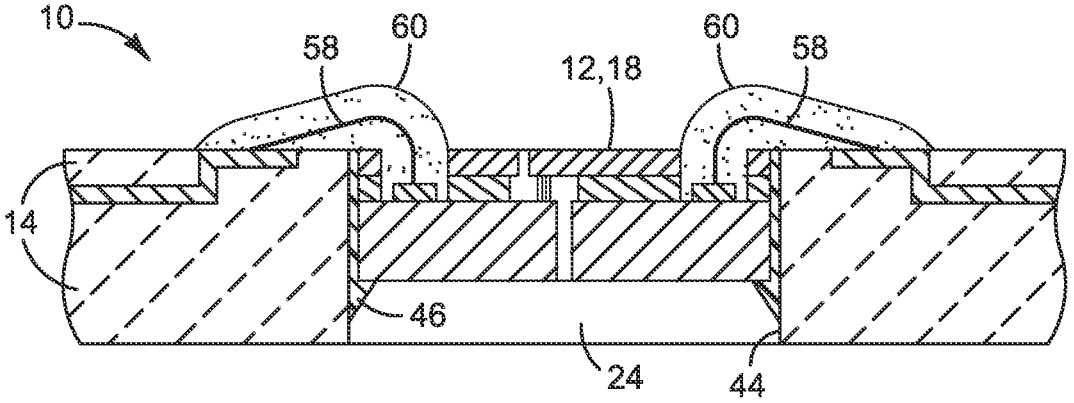
Figure 18:
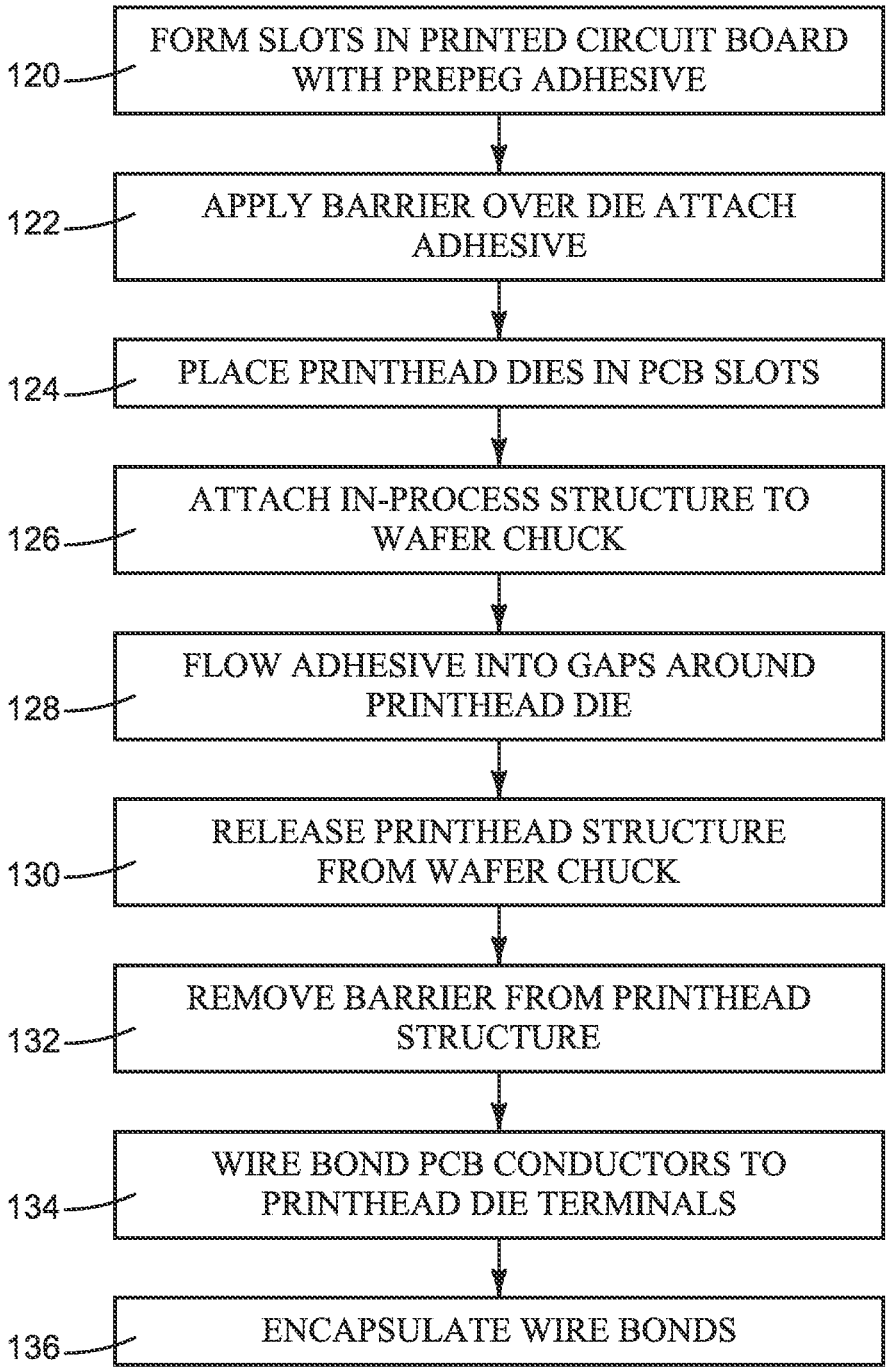

FIGS. 12-17 illustrate another example process for making a printhead structure 10. FIG. 18 is a flow diagram of the process illustrated in FIGS. 12-17. In this example, the electrical connections are made after the printhead dies are embedded in printed circuit board 14 to conductors 38 exposed on the exterior of PCB 14 adjacent to slot 44. Referring to FIG. 12, in preparation for receiving a printhead die, a slot 44 is sawn or otherwise formed in printed circuit board 14 with conductors 38 exposed along the exterior surface of PCB 14 outside slot 44 (step 120 in FIG. 18). In this example, a printed circuit board 14 pre-impregnated ("pre-preg") with an epoxy resin or other suitable adhesive is used with a high temperature tape 50 to seal printhead die 18 in slot 44. A pre-preg tape 50 may be used as an alternative to or in addition to a pre-preg PCB 14. As shown in FIG. 13, tape 50 applied to printed circuit board 14 forms a cavity 52 for receiving printhead die 18 (steps 122 and 124 in FIG. 18) and provides a mounting surface for attaching the in-process structure 54 shown in FIG. 14 to a wafer chuck 56 as shown in FIG. 15 (step 126 in FIG. 18).

In FIG. 15, the assembly is heated to flow pre-preg adhesive 46 into the gaps around printhead die 18 (step 128 in FIG. 18) to affix printhead die 18 in slot 44 and seal the embedded die 18 in channel 24. Printhead structure 10 is then released from chuck 56 and barrier 50 removed as shown in FIG. 16 (steps 130 and 132 in FIG. 18). In FIG. 17, wires 58 are bonded to conductors 38 on PCB 14 and terminals 42 on printhead 18 and the connections encapsulated in a protective covering 60 (steps 134 and 136 in FIG. 18).

A PCB flow structure 10 enables the use of long, narrow and very thin printhead dies 18. For example, a 100 μm thick printhead die 18 that is about 26 mm long and 500 μm wide can be embedded in a 1 mm thick printed circuit board 14 to replace a conventional 500 μm thick silicon printhead die. Not only is it cheaper and easier to form channels 24 in a printed circuit board compared to forming the feed channels in a silicon substrate, but it is also cheaper and easier to form printing fluid ports 28 in a thinner die 18. For example, ports 28 in a 100 μm thick printhead die 18 may be formed by dry etching and other suitable micromachining techniques not practical for thicker substrates. Micromachining a high density array of through ports 28 in a thin silicon, glass or other substrate 32 rather than forming conventional slots leaves a stronger substrate while still providing adequate printing fluid flow.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A fluid flow structure, comprising:

a printed circuit board comprising an epoxy;

a micro device embedded in the printed circuit board, the printed circuit board having:

a channel formed therein for fluid to flow to the micro device; and a conductor connected to a conductor on the micro device;

wherein the printed circuit board comprises the epoxy as an epoxy resin that is dispersed in material of the printed circuit board as a result of being pre-impregnated into the printed circuit board.

2. The structure of claim 1, wherein the micro device includes a fluid flow passage connected directly to the channel.

3. The structure of claim 1, wherein the channel comprises an open channel exposed to an external surface of the micro device.

4. The structure of claim 1, wherein the micro device is glued inside the channel in the board such that fluid flowing in the channel is brought to an upper surface of the micro device disposed down in the channel.

5. The structure of claim 4, wherein the opening comprises a slot and the micro device comprises a micro device sliver glued into the slot in the board.

6. The structure of claim 5, wherein the micro device comprises an arrangement of printhead die slivers each glued into a corresponding slot in the board.

7. The structure of claim 1, wherein:

the channel is to deliver fluid to an upper surface of the micro device, the upper surface of the micro device having an inlet to receive fluid for ejection from a second, opposite side of the micro device; and each conductor protrudes into a channel where it is connected directly to a terminal on the second side of the micro device, the conductor connecting the terminal on the second side of the micro device with a contact that is on a surface of the printed circuit board.

8. A method for making the fluid flow structure of claim 1, the method comprising:

forming the channel in the printhead circuit board;

mounting the micro device in the channel for fluid to flow to directly to the micro device through the channel; and connecting the conductor in the printed circuit board to the conductor on the micro device.

9. The method of claim 8, wherein forming a channel and mounting a micro device in the channel comprise forming slots through a printed circuit board having a thickness greater than the thickness of a micro device and gluing a micro device into each slot.

10. The method of claim 9, wherein each micro device comprises a micro device sliver and the method further comprises:

applying a harrier over each slot; placing a sliver against the harrier in each slot;

flowing adhesive around the slivers to glue the slivers into the slots;

bonding printed circuit board conductors to electrical terminals on the slivers; and removing the barrier covering each slot.

11. The method of claim 10, wherein bonding printed circuit board conductors to electrical terminals on the slivers comprises exposing a printed circuit board conductor in each slat and then bonding the exposed conductors directly to the electrical terminals on the slivers.

12. The structure of claim 1, wherein the micro device is disposed in the channel such that fluid flowing in the channel is received by an upper surface of the micro device and selectively ejected from an opposite, bottom surface of the micro device; and wherein the conductor comprises a conductive pathway that extends inside and through the printed circuit board for connection with the micro device at the bottom surface of the micro device from which fluid is selectively ejected.

13. The structure of claim 1, wherein the micro device comprises a printhead die comprising a row of orifices each having a corresponding ejection chamber, and wherein the channel runs through the printed circuit board parallel to the row of orifices.

14. The structure of claim 1, wherein the channel is sawn into the printed circuit board, the micro device being disposed in a portion of the sawn channel in the printed circuit board.

15. The structure of claim 1, wherein the printed circuit board is 1 mm thick and the printhead die is less thick than the printed circuit board and has a ratio of length to width (L/W) of at least three.

16. A printhead structure, comprising multiple printhead dies mounted in a printed circuit board having:

multiple channels therein each to provide printing fluid directly to a die; and conductors connected to electrical terminals on the dies;

wherein the printhead dies are recessed into the channels of the printed circuit board such that an upper surface of the printhead die that receives printing fluid into the die is disposed down inside the channel allowing fluid to flow within the channel over the upper surface of the printhead die; and wherein the printed circuit board comprises an epoxy as an epoxy resin that is dispersed throughout material of the printed circuit board after being pre-impregnated into the printed circuit board.

17. The structure of claim 16, wherein the printed circuit board comprises an elongated printed circuit board and the dies are arranged generally end to end along a length of the board.

18. The structure of claim 17, wherein each die comprises a die sliver glued into a respective channel in the board.

19. The structure of claim 18, wherein each printhead die sliver includes:

multiple holes connected to the channel for fluid to flow from the channel directly into the holes;

a manifold connected to the holes for printing fluid to flow from the holes directly into the manifold; and multiple ejection chambers connected to the manifold for printing fluid to flow from the manifold into the ejection chambers.

* * * * *